US005364189A

United States Patent [19]

Kuge et al.

[11] Patent Number: 5,364,189

[45] Date of Patent: * Nov. 15, 1994

[54] ZIPPERED BAG AND METHOD OF FORMING THE SAME

[75] Inventors: Raizo Kuge, Hannou; Yoshiji Moteki, Saitama, both of Japan

[73] Assignee: Kabushiki Kaisha Hosokawa Yoko, Tokyo-to, Japan

[ * ] Notice: The portion of the term of this patent subsequent to Jan. 4, 2011 has been disclaimed.

[21] Appl. No.: 144,182

[22] Filed: Oct. 27, 1993

[30] Foreign Application Priority Data

Jul. 9, 1993 [JP] Japan ..... 5-170547

[51] Int. Cl.[5] ..... B65D 33/24

[52] U.S. Cl. ..... 383/61; 383/63; 383/64; 383/120

[58] Field of Search ..... 383/61, 63, 120, 64, 383/107

[56] References Cited

U.S. PATENT DOCUMENTS 4,792,240 12/1988 Ausnit ..... 383/63
5,275,491 1/1994 Kuge et al. ..... 383/63 X

FOREIGN PATENT DOCUMENTS 0085162 3/1990 Japan ..... 383/63
2263662 8/1993 United Kingdom .

*Primary Examiner*—Gary E. Elkins
*Assistant Examiner*—Jes F. Pascua
*Attorney, Agent, or Firm*—Ladas & Parry

[57] ABSTRACT

A gusset bag for packing a content comprises a bag body having a tubular structure and composed of a pair of opposing flat portions constituting front and back surface portions and two side surface portions connecting the front and back surface portions at both side edges thereof and having lines folded inward which extend along longitudinal direction of the side surface portions and along which the side surface portions are folded inward. A zipper element is mounted on inner surfaces of the flat portions at portions near the end opening of the bag body. A fused seal portion formed to and near the end opening portion of the bag body to seal the end opening portion, the fused seal portion including an end seal portion extending along an entire length of the end opening and side seal portions extending from both ends of the end seal portion along the side edges of the flat portions. The side seal portions extend beyond the portions on which the zipper element is mounted. The sealing process is carried out integrally with portions of the side surface portions, which are once inwardly folded along the folding lines and then drawn out and folded outward from the end opening of the bag body. The zipper element is mounted to the portions near the end opening between the end opening and the once folded and then drawn out side surface portions.

6 Claims, 7 Drawing Sheets

ZIPPERED BAG AND METHOD OF FORMING THE SAME

BACKGROUND OF THE INVENTION

This invention relates to a zippered bag, and more particularly, gusset bag provided with a zipper element for opening or closing an end opening of the bag through which a content filling in the bag can be easily taken out, and also is concerned with a method of forming such zippered bag.

In the known art, there has been provided a flat bag container having opposing flat portions, and four side peripheries of such bag are heat sealed (four side seal bag), and an opening of the bag through which an inner content can be taken out is closed or opened by providing a zipper element. With such flat bag, it is possible to manufacture the bag by making coincident the delivery direction of a film material forming a flat bag container with a supply direction of the zipper element, thus being advantageous in a productivity.

Further, recently, it is attempted to apply the zipper element to a bag other than the four side seal bag, and in such attempt, a cap shaped bag member provided with a zipper element is preliminarily prepared and the cap shaped bag member is then applied to a bag body prepared separately from the cap shaped bag member. For example, a gusset bag provided with gores at both side portions of the bag body has a good self-supporting property and a relatively large inner capacity, and accordingly, the usage thereof is widened and the application of the zipper element to the gusset bag has been desired.

However, since the gusset bag has a folded portion as gusset, it involves a problem of difficult attachment of the zipper element and many other points to be improved for the structure of such gusset bags.

SUMMARY OF THE INVENTION

An object of this invention is to substantially eliminate defects or problems encountered in the prior art and to provide a gusset bag provided with a zipper element which can be easily attached to the gusset bag and also provide a method of forming the bag provided with the zipper element.

This and other objects can be achieved according to this invention by providing, in one aspect, a gusset bag having one end to be formed as a bottom end and another end to be formed as an end opening through which a content packed in the gusset bag is taken out, the gusset bag being characterized by comprising:

a bag body having a tubular structure and composed of a pair of opposing flat portions constituting front and back surface portions of the bag body and two side surface portions connecting the front and back surface portions at both side edges thereof and respectively having lines folded inward which extend along longitudinal direction of the side surface portions and along which the side surface portions are folded inward;

a zipper element mounted on inner surfaces of the flat portions at portions near the end opening of the bag body; and a fused seal portion formed to and near the end opening portion of the bag body to substantially entirely seal the end opening portion, said fused seal portion including an end seal portion extending substantially along an entire length of the end opening and side seal portions extending from both ends of the end seal portion along the side edges of the flat portions of the bag body, the side seal portions each extending beyond the portions on which the zipper element is mounted, wherein a sealing process is carried out integrally with portions of the side surface portions near the end opening of the bag body, which are once inwardly folded along the folding lines and then drawn out and folded outward from the end opening of the bag body for once opening the end opening and wherein the zipper element is mounted to the portions near the end opening portion of the bag body between the end opening portion and the once folded and then drawn out side surface portions.

In a preferred embodiment, the zipper element is provided with flat side end portions to be fused together with the side seal portions. The zipper element extends throughout a whole horizontal length of the bag body and the zipper element comprises a male member to be attached to an inner surface of one of the flat portions of the bag body and a female member to be engaged with the male member and attached to an exposed inner surface of another one of the flat portions of the bag body, the male and female members being attached at portions apart by equal distances from the end opening of the bag body and also from the once inwardly folded and then drawn out side surface portions, and both side end portions to be fused of the male and female members are made flat. Both the side end portions are made flat through heat seal process.

The side seal portions are inwardly cut with predetermined widths along the longitudinal direction of the bag body after the sealing process is carried out.

In another aspect, there is provided a method of forming a gusset bag provided with a zipper element characterized by comprising the steps of:

preparing a bag body having a tubular structure and composed of a pair of opposing flat portions constituting front and back surface portions of the bag body and two side surface portions connecting the front and back surface portions at both side edges thereof and respectively having lines folded inward which extend along longitudinal direction of the side surface portions and along which the side surface portions are folded inward;

drawing out and outwardly folding portions of the side surface portions near an end opening of the bag body, which are once inwardly folded along the folding lines, with base points for the outward folding being optionally determined on the folding line, to thereby from arris lines inwardly projecting inside the bag body from four corner portions of the end opening of the bag body to the base points;

opening outwardly portions of the flat surface portions and the side surface portions of the bag body along a base line formed by connecting most outward points of the outwardly folded lines of the side surface portions of the bag body so as to expose inner surfaces of these portions outward;

preparing a zipper element composed of a male member and a female member to be engaged with the male member;

mounting the male and female members on the exposed inner surfaces of the flat portions of the bag body, respectively, at portions apart by equal distances from the end opening of the bag body and from the outwardly folded side surface portions;

closing the end opening by engaging the male member with the female member as the zipper element; and fusing the end opening of the bag body together with the outwardly folded side surface portions thereof to thereby seal the end opening and the bag body.

In a preferred embodiment, the bag body preparing step includes a cutting process for cutting the bag body from the end opening thereof along lines connecting the flat surface portions and the side surface portions of the bag body to form four cuts each having a predetermined length and the cut portions of the side surface portions are once folded inward and then drawn out and both side end portions of the zipper element are positioned between these drawn out portions and the end opening of the bag body. The side end portions of the zipper element to be fused together with the side seal portions are made flat through heat seal process, and the side seal portions are inwardly cut with predetermined widths along the longitudinal direction of the bag body after the sealing process is carried out.

According to the embodiments of the characters described above, the bag body is preliminarily formed by an ordinary manner. Thus, the side end portions of the upper opening portion of the bag body are cut by predetermined lengths along the folded lines to thereby bent outwardly to partially expose the inner surfaces of the flat portions of the upper portion of the bag body along the line connecting the bottoms (or ends) of the two cuts. The male and female members constituting the zipper element are attached to the exposed surfaces, respectively, to the portions not overlapped to the exposed and outwardly folded side surface portions near the opening portion of the bag body. According to this structure, the zipper element can be easily and surely attached to the bag body. Since the exposed portions of the flat portions are not overlapped to the cut and exposed side end portions, the sealing can be easily done in the viewpoint of heat transfer and furthermore, when the zipper element is secured to these portions, the folded side surface portions are positioned below the attachment of the zipper element with respect to the end opening of the bag body, so that it is possible to make wide the end opening of the bag body.

Still furthermore, the side end portions of the male and female members are made flat, so that cracks or the like are hardly caused to these portions of the film forming the bag body.

The further nature and features of this invention will be made more clear through the following descriptions made with reference to the accompanying drawings.

DESCRIPTION OF THE PREFERRED EMBODIMENTS

Figure 1:
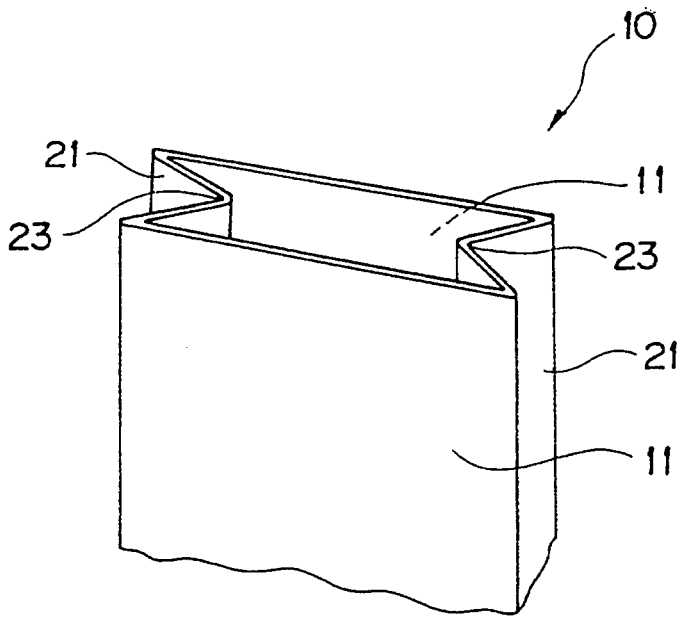
FIGS. 1 to 7 are perspective views of a gusset bag provided with a zipper element attached to a predetermined position of one embodiment according to this invention in accordance with forming steps thereof in this order of the figure numbers.

One embodiment of a gusset bag provided with a zipper element of this invention will be first described hereunder with reference to FIGS. 1 to 9.

Referring to FIGS. 1 to 9, a gusset bag 1 provided with a zipper element 30 has a bag body 10 composed of a pair of opposing flat portions forming front and back surface portions 11 and 11 of the bag 1 and two side surface portions 21 and 21 having folding lines 23 and 23 which extend vertically substantially along the central lines of the side surface portions and along which the side surface portions 21 and 21 are folded inwardly of the bag body 10. The bag body 10 is usually formed of a plastic film, paper, aluminum foil or lamination member of these materials, but according to this invention, the material is not specifically limited. The zipper element 30 is provided to the inner surfaces of the flat portions 11 and 11 at portions near an end opening, i.e. mouth portion Q, of the bag body for freely opening or closing the opening Q of the bag body 10.

Figure 7:
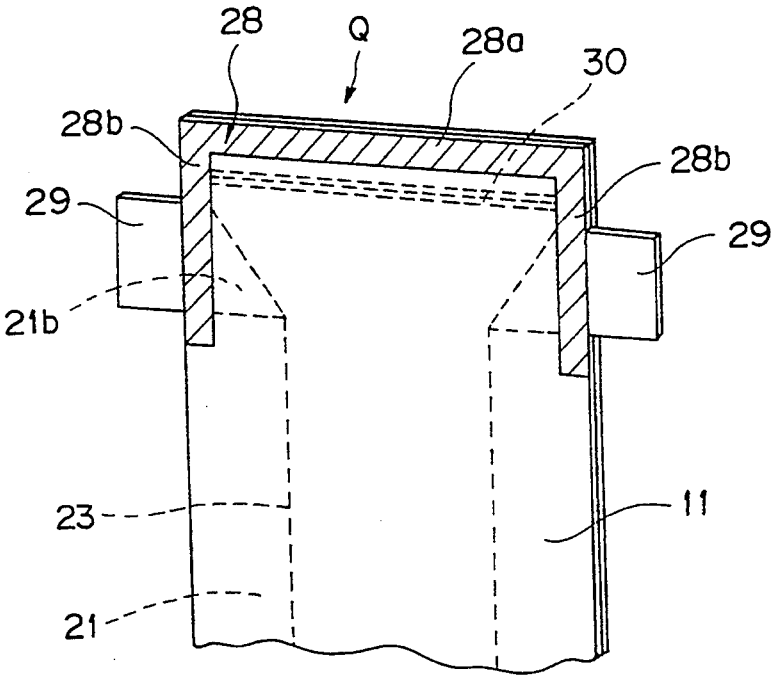

The bag body 10 has a fused seal portion 28, shown with hatching lines in FIG. 7, for example, which seals an entire upper end area **28*a* of the opening Q of the bag body 10 and side areas 28*b* and 28*b* extending from both lateral ends of the upper end area 28*a* towards portions further downward of folded side surface portions 21*b* and 21*b* to seal the side areas 28*b* and 28*b***.

The reason why the sealing is effected to the portions further downward of the folded side surface portions **21*b* is to seal openings formed to the side portions of the folded side surface portions 21*b* and to fix to some extent the folded side surface portions 21*b* by integrally sealing portions thereof with the side surface portions 21 of the bag body 10, which further contributes an addition of protection strength of the both side seal portions of the zipper element 30**.

According to the sealing of the fused seal portion 28, the portions of the folded side surface portions **21*b* are sealed integrally with the flat portions 11 and 11 of the bag body 10 with these portions being sandwiched between portions of the flat portions 11 and 11 constituting the front and back surface portions of the bag body 10**. Further, this state will be made more clear through the following descriptions made in relation to a manufacturing method of the gusset bag.

Figure 10:
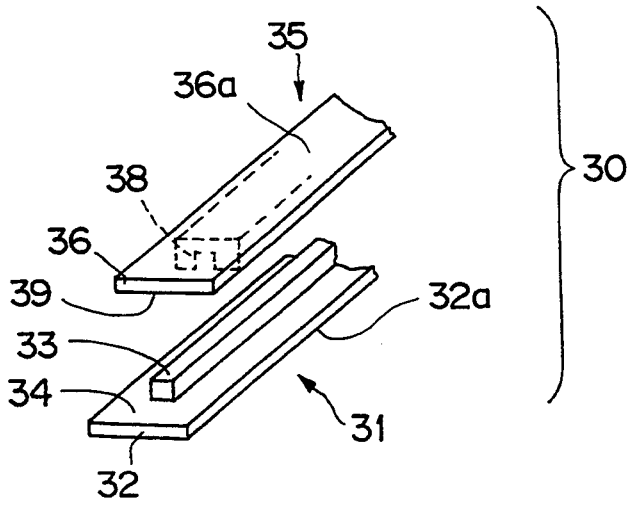
FIG. 10 is a developed perspective view of the zipper element to be applied to the gusset bag of this invention.

The zipper element 30 has a belt shape structure, as shown in FIG. 10, in combination of a male member 31 and a female member 35 to be engaged with the male member 31. The male member 31 is composed of a flat base plate 32 and a belt like protruded portion 33 formed on one side of the base plate 32. The other side **32*a* of the base plate 32 has a flat surface capable of being bonded to the inner surface of one flat portion 11 of the bag body 10. The female member 35 is composed of a flat base plate 36 and a belt like member 38 having a recessed portion formed on one side of the base plate 36. The other side 36*a* of the base plate 36 has a flat surface capable of being bonded to the inner surface of the other flat portion 11 of the bag body 10. The sizes of the protruded portion of the male member 31 and the recessed portion of the female member 35** are designed to be tightly engaged with each other when mated.

According to the embodiment of this invention, the zipper element 30 is provided with side end portions 34 and 34 (FIG. 9) to be sealed which are preliminarily formed to be flat for hardly causing cracks or the like to the film material of the bag body 10 when the side end portions of the zipper element 30 are heat sealed or after the heat sealing operation. This flattening working to the side end portions to be sealed of the zipper element 30 is especially effective for the case of using the film of a multilayer structure utilizing the aluminum foil. This flattening working will be performed by using a pressure head or a heated pressure head to thereby crush both side end portions 34 and 34 to be sealed of the zipper element 30.

Such zipper element as provided with the crushed side end portions will attain itself an excellent effect if it be used for a zippered bag other than the zippered gusset bag according to this invention.

The gusset bag 1 according to the embodiment of this invention is formed or manufactured by way of the following steps.

First, with reference to FIG. 1, there is prepared a cylindrical or tubular bag body 10 formed with a pair of flat portions 11 and 11 constituting front and back side surface portions of the bag body 10 and two side surface portions 21 and 21 having lines 23 and 23 to be folded inwardly, the lines extending vertically substantially along the central lines of the side surface portions 21 and 21.

Figure 2:
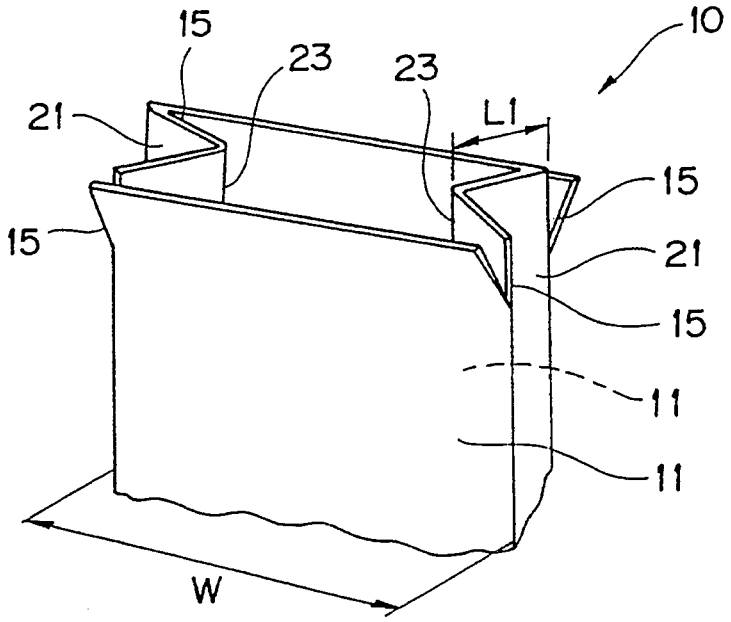

Next, as shown in FIG. 2, four cuts 15, 15, 15 and 15 are made along lines through which the side surface portions 21 and 21 are connected to the flat portions 11 and 11 at four corner portions of the bag body 10 so as to extend from the upper ends, as viewed, of the bag body 10 to portions each apart from the upper end by a predetermined distance. These cuts 15 have substantially the same cut depth and are formed to ensure a portion to which the zipper element 30 can be surely attached. In a case where a width L1 of the side portion to be folded is relatively small with respect to a width W of the bag body 10, for example, $L1/W=0.10$ to 0.13, the formation of such cuts is particularly effective.

Figure 3:
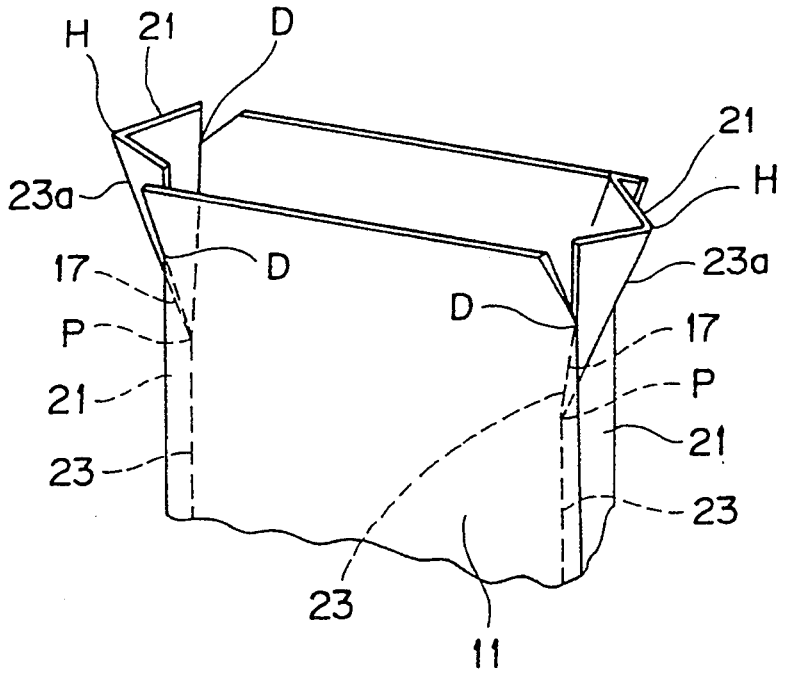
Figure 4:
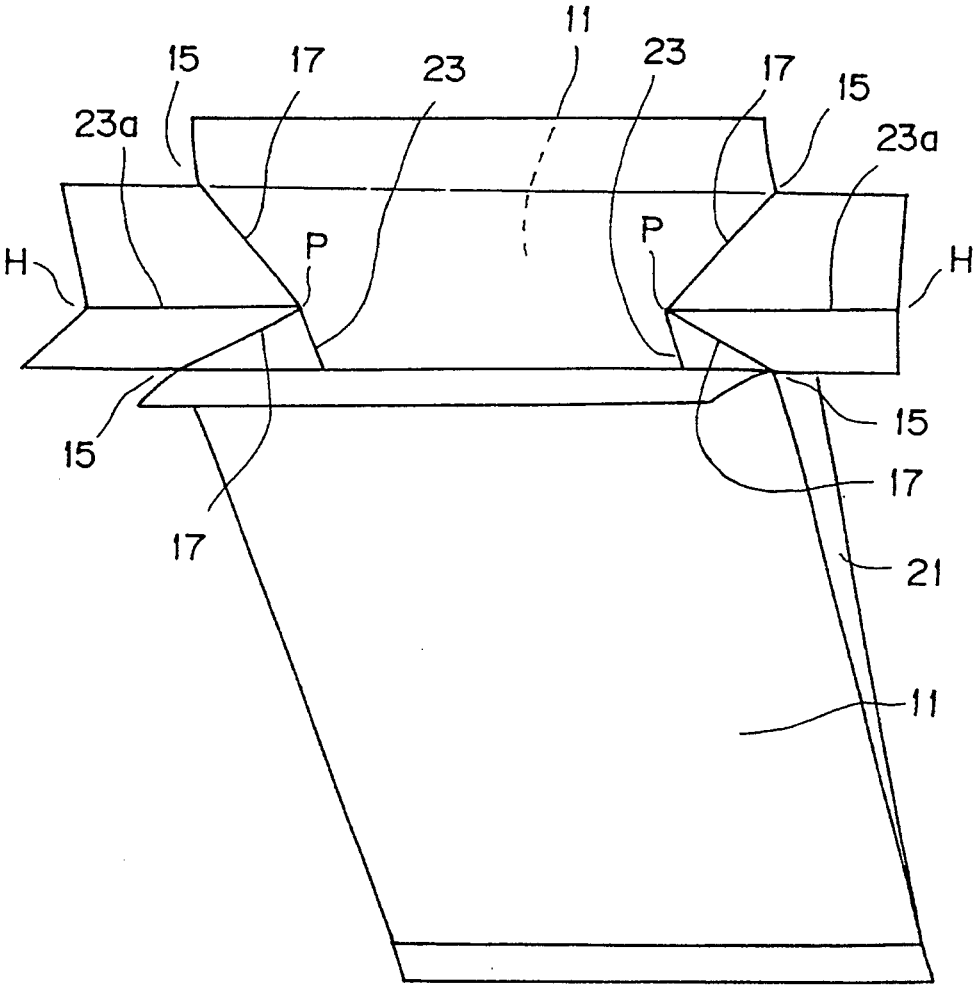

In the next step, as shown in FIG. 3, the opening of the bag body 10 is opened by partially folding reversely, i.e. outwardly, the folding lines 23 and 23 at optional portions P and P being base points. Namely, portions of the folding lines each having a length from the point P to a point H at the upper end of the bog body 10 are reversely, i.e. outwardly, pulled out and folded as folding lines **23*a* and 23*a*. According to this reverse folding, lines connecting the four corner portions, in this example, four portions D of the four cuts 15, of the bag body 10 to the points P are necessarily formed as four arris lines 17, 17, 17 and 17 as shown in FIG. 3. the arris lines 17 project in the inward direction of the bag body 10**, respectively.

Figure 5:
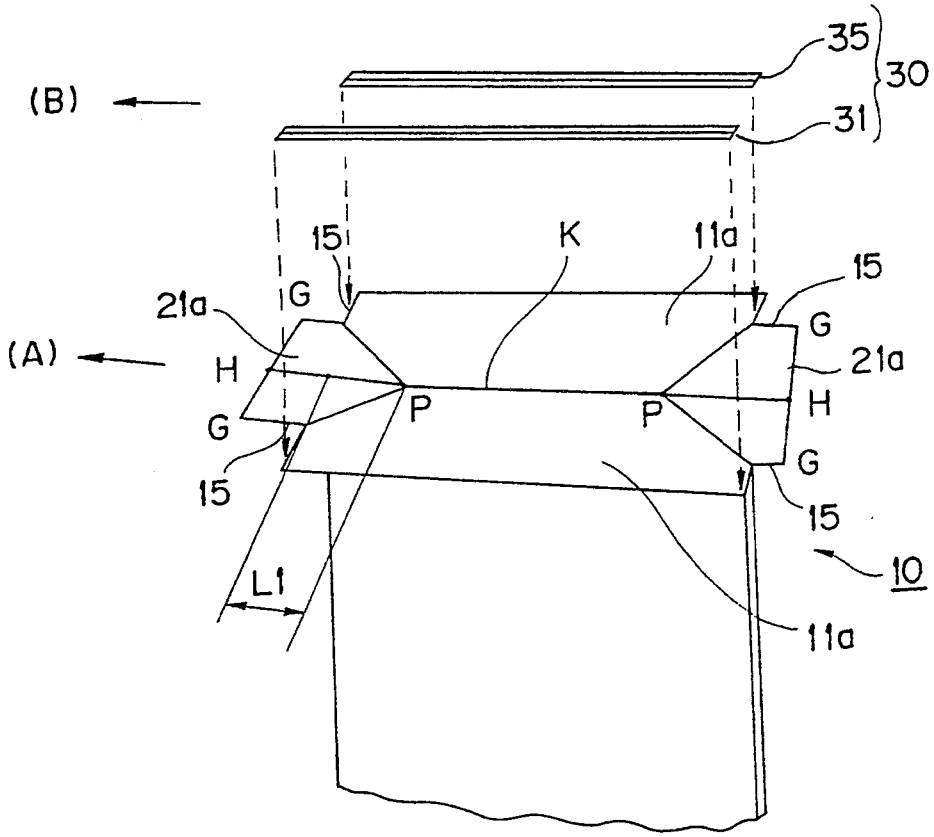

As shown in FIG. 5, in the next step, the upper portions of the flat portions 11 and the side portions 21 are together folded or bent outward with a base line K which connects the points H and H, i.e. upper ends of the outwardly folded lines, thus forming four opened surfaces of the bag body 10. In this embodiment, as the base points P are set so that length of the line GH shown in FIG. 5 is substantially equal to the width L1, the opened surfaces **11*a* and 21*a* constitute flat surfaces lying substantially the same plane. In this step, the bag body 10 is delivered in a direction N, and during this step, the belt like male member 31 and female member 35 forming the zipper element 30 are conveyed above the opened surfaces 11*a* and 21*a* along a direction J, thus the conveying directions N and J of the bag body 10 and the zipper element 30** accord with each other, whereby the working of the bag body can be easily made and is suitable for a machine working.

Figure 6:
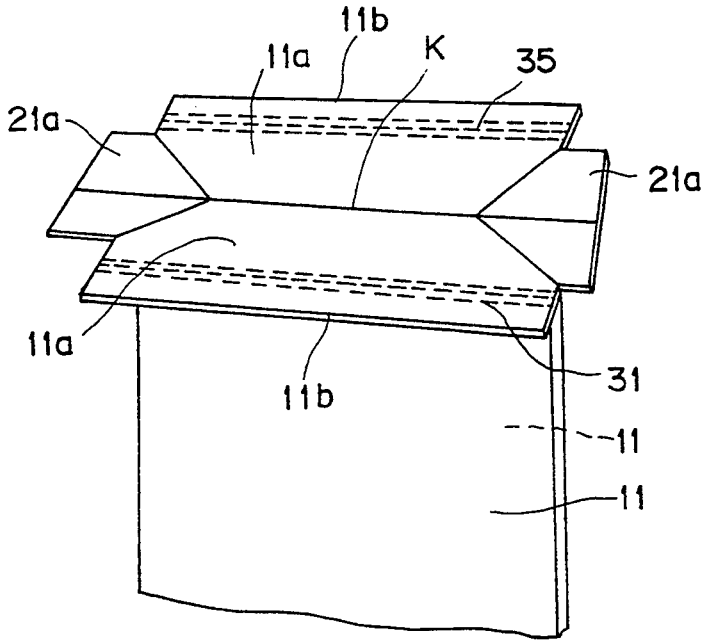

Further, in the next step, as shown in FIG. 6, the male member 31 and the female member 35 forming the zipper element 30 are fixed to the exposed opened surfaces **11*a* and 21*a* apart from equal distances from the central line, i.e. line K, usually in parallel with each other and at portions not overlapped with the opened surfaces 21*a* and 21*a* of the side surface portions 21 and 21 along the end edge lib of the flat portion 11. the fixing of the male and female members 31 and 35 of the zipper element 30 is usually effected by the heat press seal method. According to this fixing method, since the male and female members are fixed to the portions not overlapped with the outwardly opened surfaces 21*a* of the side surface portions 21**, the sealing can be easily done in the view point of the hear transferring.

Figure 8:
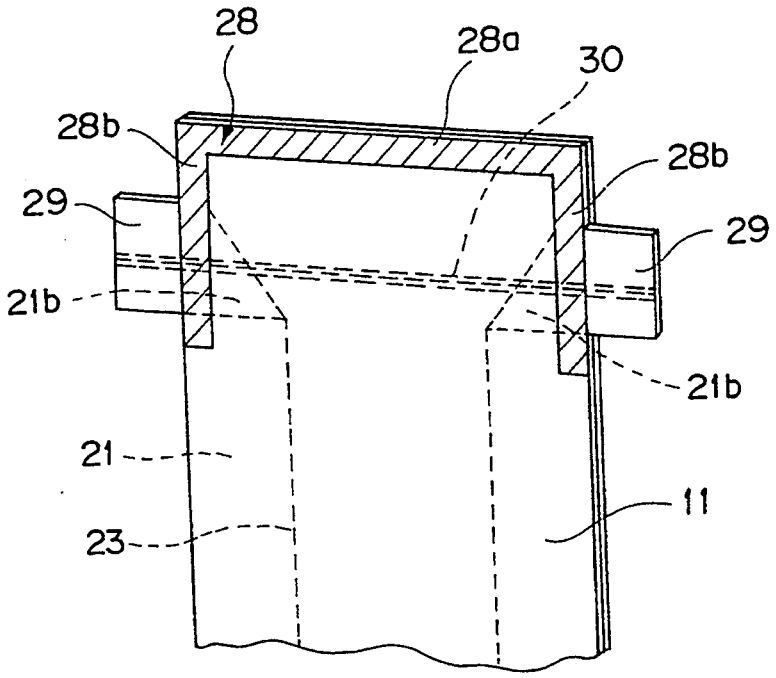
FIG. 8 is a perspective view of a gusset bag provided with a zipper element attached to a portion different from that of this invention shown in FIG. 7.

When the zipper element 30 is fixed to these portions, as shown in FIG. 7, since the zipper element 30 and the folded side portions **21*b* are not sealed together, the opening Q of the bag body 10 can be formed with the width same as that of the opening Q, the content in the gusset bag 1 can be easily taken out. In this connection, as shown in FIG. 8, when the zipper element 30 is fixed to the portions of the exposed portions 11*a* (FIG. 6) overlapped with the opened surfaces 21*a* and 21*a* of the side portions 21, the zipper element 30 and the side surface portions 21*a* are sealed together, so that the width of the opening Q is rendered narrow by the width corresponding to the sealed portions of the zipper element 30 and the side portions 21*a*, thus being inconvenient for taking out the content in the bag body 10**.

In the next step, as shown in FIG. 7, the opened surfaces **11*a* and 11*a* are closed so that the male and female members 31 and 35 are mated and engaged with each other so as to function as the zipper element 30. Thereafter, the upper end portion 28*a* forming the opening end of the bag body 10 is entirely fused and sealed, and the side portions 28*b* of the bag body 10 are also fused to portions further downward of the folded side portions 21*b*, thus forming the tightly fused seal portion 28 of the upper portion of the bag body 10**.

Figure 9:
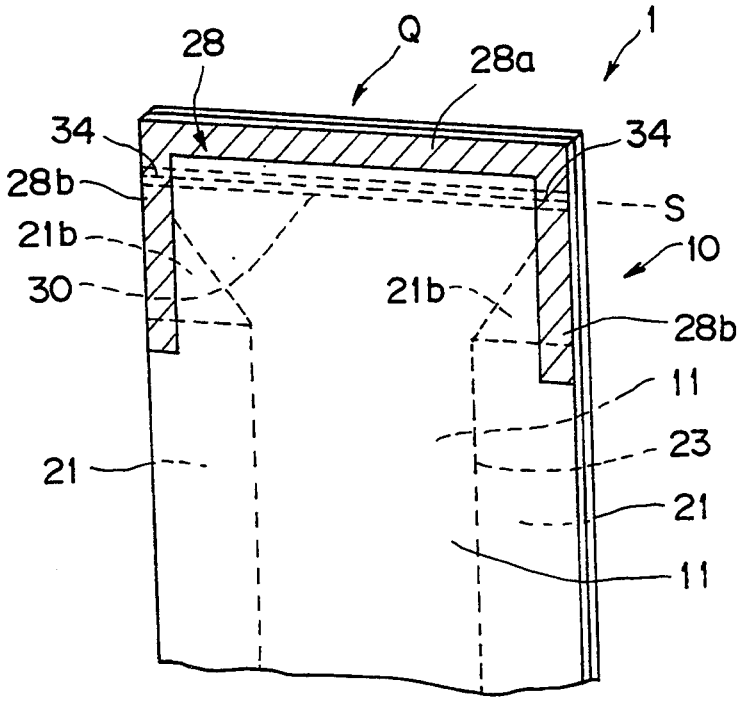
FIG. 9 is a perspective view of the gusset bag provided with the zipper element as a final product of this embodiment.

After this step, tubs 29 and 29 projecting from the sides of the bag body 10 are cut out along the vertical side ends of the bag body 10, thus completing the gusset bag 1 provided with the zipper element 30 as shown in FIG. 9.

Figure 11:
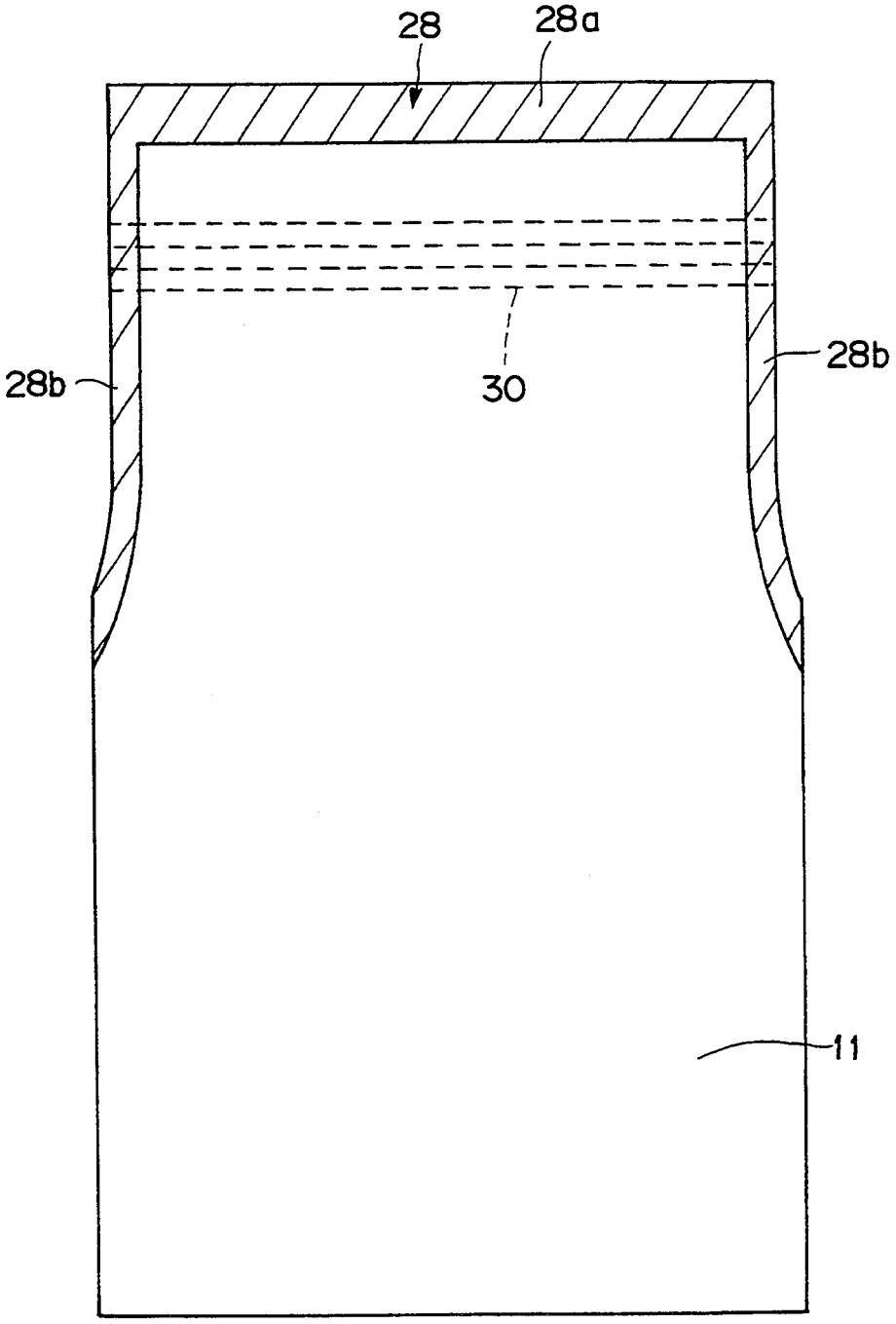
FIG. 11 is a perspective view of a gusset bag provided with a zipper element according to another embodiment of this invention.

FIG. 11 represents a modified embodiment of the gusset bag according to this invention, in which side portions **28*b* of the bag body 10 positioned slightly inside the side edges thereof are fused and the side portions 28 are cut out with a predetermined small width along the side edges to provide the fused side portions 28*b* recessed inwardly of the bag body 10. According to this modification, the projected portions of the zipper element 30 and the tubs 29 from the side edge of the bag body 10** can be removed, providing a fine cut surfaces.

A content to be contained in the gusset bag thus formed is usually packed from the bottom side now being opened, and the bottom side is thereafter fused and sealed. On the contrary, it may be possible to provide the bag body having the bottom side initially sealed. In this case, the content is packed from the upper opening by opening the zipper element 30 and the zipper element 30 is then closed and the upper end portion 28*a* is finally sealed. According to this invention, it is possible to fix the zipper element 30 to the opened surface of the bag body 10 with the male and female members 31 and 35 being engaged.

According to the embodiment of this invention, the bag body is preliminarily formed by an ordinary manner. Thus, the side end portions of the upper opening portion of the bag body are cut by predetermined lengths along the folded lines to thereby bent outwardly to partially expose the inner surfaces of the flat portions of the upper portion of the bag body along the line connecting the bottoms (or ends) of the two cuts. The male and female members constituting the zipper element are attached to the exposed surfaces, respectively, to the portions not overlapped to the exposed and outwardly folded sidesurface portions near the opening portion of the bag body. According to this structure, the zipper element can be easily and surely attached to the bag body. Since the exposed portions of the flat portions are not overlapped to the exposed and outwardly folded side surface portions, the sealing can be easily done in the viewpoint of heat transfer, and furthermore, when the zipper element is secured to these portions, the folded side portions are positioned below the attachment of the zipper element with respect to the end opening of the bag body, so that it is possible to make wide the end opening of the bag body.

Still furthermore, the side end portions of the male and female members are made flat, so that cracks or the like are hardly caused to these portions of the film forming the bag body.

It is to be understood that this invention is not limited to the embodiments described above and many other changes or modifications may be made without departing from the scope of the appended claims.

What is claimed is:

1. A gusset bag having one end to be formed as a bottom end and another end to be formed as an end opening through which a content packed in the gusset bag is taken out, the gusset bag comprising:

a bag body having a tubular structure and composed of a pair of opposing flat portions constituting front and back surface portions of the bag body, said front and back surface portions having respectively two side edges, and two side surface portions connecting the front and back surface portions at both side edges thereof and respectively having lines folded inward which extend along longitudinal direction of the side surface portions an along which the side surface portions are folded inwardly a zipper element mounted on inner surfaces of the flat portions at portions near the end opening of the bag body; and a fused seal portion formed to and near the end opening portion of the bag body to substantially entirely seal the end opening portion said fused seal portion including an end seal portion having two ends and extending substantially along an entire length of the end opening and side seal portions extending from both ends of the end seal portion along the side edges of the flat portions of the bag body, said side seal portions each extending beyond the portions on which the zipper element is mounted, wherein a sealing process is carried out integrally with portions of the side surface portions near the end opening of the bag body, which are once inwardly folded along the folding lines and then drawn out and folded outward from the end opening of the bag body for once opening in the end opening and wherein the zipper element is mounted to the portions near the end opening portion of the bag body between the end opening portion and the once folded and then drawn out side surface portions.

2. A gusset bag according to claim 1, wherein said zipper element is provided with flat side end portions to be fused together with the side seal portions.

3. A gusset bag according to claim 2, wherein said zipper element extends throughout a whole horizontal length of the bag body and said zipper element comprises a male member to be attached to an inner surface of one of the flat portions of the bag body and a female member to be engaged with the male member and attached to an exposed inner surface of another one of the flat portions of the bag body, said male and female members being attached at portions apart by equal distances from the end opening of the bag body and also from the once inwardly folded and then drawn out side surface portions, and both side end portions to be fused of the male and female members are made flat.

4. A gusset bag according to claim 3, wherein both the side end portions of the zipper element are made flat through heat seal process.

5. A gusset bag according to claim 1, wherein the side seal portions are inwardly cut with predetermined widths along the longitudinal direction of the bag body after the sealing process is carried out.

6. A gusset bag according to claim 5, wherein said zipper element is provided with flat side end portions to be fused together with the side seal portions.

* * * * *